US010777945B2

(12) United States Patent
Corwin et al.

(10) Patent No.: US 10,777,945 B2
(45) Date of Patent: Sep. 15, 2020

(54) SHORTING BLOCK FOR A CURRENT TRANSFORMER

(71) Applicant: Schweitzer Engineering Laboratories, Inc., Pullman, WA (US)

(72) Inventors: Beth LaRae Corwin, Post Falls, ID (US); Gerald K. Hein, Pullman, WA (US); Mike Timothy Strickler, Lewiston, ID (US)

(73) Assignee: Schweitzer Engineering Laboratories, Inc., Pullman, WA (US)

( * ) Notice: Subject to any disclaimer, the term of this patent is extended or adjusted under 35 U.S.C. 154(b) by 0 days.

(21) Appl. No.: 16/268,211

(22) Filed: Feb. 5, 2019

(65) Prior Publication Data

US 2020/0251859 A1 Aug. 6, 2020

(51) Int. Cl.

| | |
|---|---|
| ***H01R 13/703*** | (2006.01) |
| ***H01R 9/24*** | (2006.01) |
| ***H01F 30/06*** | (2006.01) |
| ***H01R 25/00*** | (2006.01) |

(52) U.S. Cl.

CPC ..... *H01R 13/7034* (2013.01); *H01F 30/06* (2013.01); *H01R 9/2433* (2013.01); *H01R 9/2491* (2013.01); *H01R 25/006* (2013.01)

(58) Field of Classification Search

CPC ..... H01R 13/703; H01R 13/71; H01R 13/70; H01R 13/713; H01R 24/46; H01R 9/2491; H01R 9/2433; H01R 25/006

USPC ..... 439/188; 200/51.1

See application file for complete search history.

(56) References Cited

U.S. PATENT DOCUMENTS

| | | | | |
|---|---|---|---|---|
| 1,815,233 A | | 7/1931 | Burke | |
| 2,923,913 A | | 2/1960 | Kulka | |
| 2,990,534 A | | 6/1961 | Nielsen | |
| 3,512,043 A | | 5/1970 | Jaaksoo | |
| 3,627,929 A | * | 12/1971 | Gilissen | H01R 13/7033 200/51.1 |
| 4,133,598 A | | 1/1979 | Kuntzsch | |
| 4,179,173 A | | 12/1979 | Rise | |

(Continued)

FOREIGN PATENT DOCUMENTS

WO 0189037 11/2001

OTHER PUBLICATIONS

Hein, Jerry, "Installing and Servicing Connectors for Connectorized® Relays", SEL Application Guide, vol. VI. Apr. 9, 2001.

*Primary Examiner* — Hien D Vu

(74) *Attorney, Agent, or Firm* — Fletcher Yoder, P.C.; Richard M. Edge

(57) ABSTRACT

A shorting block includes a first shorting contact having a first contact portion, a second shorting contact having a second contact portion, the first contact portion and the second contact portion may electrically couple the first shorting contact and the second shorting contact in a shorting position of the shorting block, a first activation, and a second activation contact, the first activation contact and the second activation contact may be inserted into the first shorting contact and the second shorting contact, respectively, such that the first activation contact and the second activation contact direct the first contact portion and the second contact portion away from one another to form a gap between the first contact portion and the second contact portion in an operating position of the shorting block.

19 Claims, 11 Drawing Sheets

(56) References Cited

U.S. PATENT DOCUMENTS

| | | | | | |
|---|---|---|---|---|---|
| 4,184,733 | A | | 1/1980 | Schmeling | |
| 4,210,379 | A | | 7/1980 | Vachhani | |
| 4,685,887 | A | | 8/1987 | Hanning | |
| 4,804,339 | A | * | 2/1989 | Cohen | H01R 13/40 439/188 |
| D331,224 | S | | 11/1992 | Robertson | |
| 5,263,872 | A | | 11/1993 | Marpoe | |
| 5,273,448 | A | * | 12/1993 | Myer | H01R 13/7033 439/188 |
| 5,286,215 | A | * | 2/1994 | Dewey | H01R 12/721 439/188 |
| 5,407,367 | A | | 4/1995 | Robertson | |
| 5,456,612 | A | * | 10/1995 | van Grunsven | H01R 31/08 439/188 |
| 5,466,168 | A | | 11/1995 | Liebich | |
| 5,509,817 | A | | 4/1996 | Tsuji | |
| 5,605,479 | A | | 2/1997 | Kramer | |
| 5,713,766 | A | | 2/1998 | Davies | |
| 5,741,161 | A | | 4/1998 | Cahaly | |
| 5,791,923 | A | * | 8/1998 | Picaud | H01R 13/05 439/188 |
| D405,053 | S | | 2/1999 | Tan | |
| 5,897,389 | A | | 4/1999 | Dietz | |
| 6,488,520 | B1 | | 12/2002 | Hayes | |
| D492,653 | S | | 7/2004 | Hein | |
| 6,835,079 | B2 | | 12/2004 | Gentry | |
| 7,275,946 | B2 | | 10/2007 | Ohtaka | |
| 7,402,057 | B1 | | 7/2008 | Strang | |
| 7,402,058 | B2 | | 7/2008 | Hoemann | |
| 7,497,708 | B2 | | 3/2009 | Geismayr | |
| D593,952 | S | | 6/2009 | Derksen | |
| 7,909,633 | B1 | | 3/2011 | Miller | |
| 7,955,104 | B1 | | 6/2011 | Wick | |
| D680,497 | S | | 4/2013 | Lan | |
| 8,449,319 | B2 | | 5/2013 | Fujii | |
| D706,221 | S | | 6/2014 | Grant | |
| D831,575 | S | | 10/2018 | Moreno | |
| 2016/0190750 | A1 | | 6/2016 | Shinmi | |
| 2016/0285211 | A1 | | 9/2016 | Tedeschi | |

* cited by examiner

SHORTING BLOCK FOR A CURRENT TRANSFORMER

FIELD OF DISCLOSURE

The present disclosure relates generally to the field of current transformers. More specifically, examples of the present disclosure relate to shorting blocks for current transformers.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Current transformers scale a supply current or voltage to a suitable value for a secondary power source or load, such as another transformer and/or a relay. For instance, current transformers may transform a high-voltage current to a level that may be suitable for operation of the secondary power source or load. In some cases, installation and/or maintenance procedures may involve connecting or disconnecting the current transformer from the secondary power source or load. Shorting blocks are utilized to disconnect the current transformer from the secondary power source or load while maintaining the high-voltage current of the current transformer within a closed-loop circuit. In other words, shorting blocks short circuit the current transformer while disconnecting the current transformer from the secondary power source or load. Unfortunately, existing shorting blocks are relatively large and expensive.

BRIEF DESCRIPTION

Certain examples commensurate in scope with the originally claimed subject matter are discussed below. These examples are not intended to limit the scope of the disclosure. Indeed, the present disclosure may encompass a variety of forms that may be similar to or different from the examples set forth below.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

In accordance with one example, a shorting block includes a first shorting contact that may be electrically coupled to a first terminal of a current transformer, where the first shorting contact has a first contact portion, a second shorting contact that may be electrically coupled to a second terminal of the current transformer, where the second shorting contact has a second contact portion, and where the first contact portion and the second contact portion may electrically couple the first shorting contact and the second shorting contact in a shorting position of the shorting block, a first activation contact that may be electrically coupled to a load, and a second activation contact that may be electrically coupled to the load, where the first activation contact and the second activation contact may be inserted into the first shorting contact and the second shorting contact, respectively, such that the first activation contact and the second activation contact direct the first contact portion and the second contact portion away from one another to form a gap between the first contact portion and the second contact portion in an operating position of the shorting block.

In accordance with another example, an electric power system includes a current transformer having a primary winding and a secondary winding, a load that may be electrically coupled to the secondary winding of the current transformer, and a shorting block that may couple the current transformer to the load. The shorting block includes a first shorting contact that may be electrically coupled to a first terminal of the current transformer, a second shorting contact that may be electrically coupled to a second terminal of the current transformer, where the first shorting contact and the second shorting contact may contact one another in a shorting position of the shorting block, a first activation contact that may be electrically coupled to the load, and a second activation contact that may be electrically coupled to the load, where the first activation contact and the second activation contact may contact the first shorting contact and the second shorting contact, respectively, to form a gap between the first shorting contact and the second shorting contact in an operating position of the shorting block.

In accordance with another example, a connector for a shorting block includes a body that may be coupled to a current transformer, an overlapping member coupled to the body, a biased portion coupled to the overlapping member via a bent portion, where the overlapping member and the biased portion overlap with one another with respect to a width of the body, a first contact portion coupled to the biased portion, where the biased portion may bias the first contact portion in a direction away from the overlapping member, and a second contact portion coupled to the base, where a gap is formed between the first contact portion and the second contact portion in a shorting position of the shorting block, and where the first contact portion and the second contact portion are electrically coupled to one another in an operating position of the shorting block.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
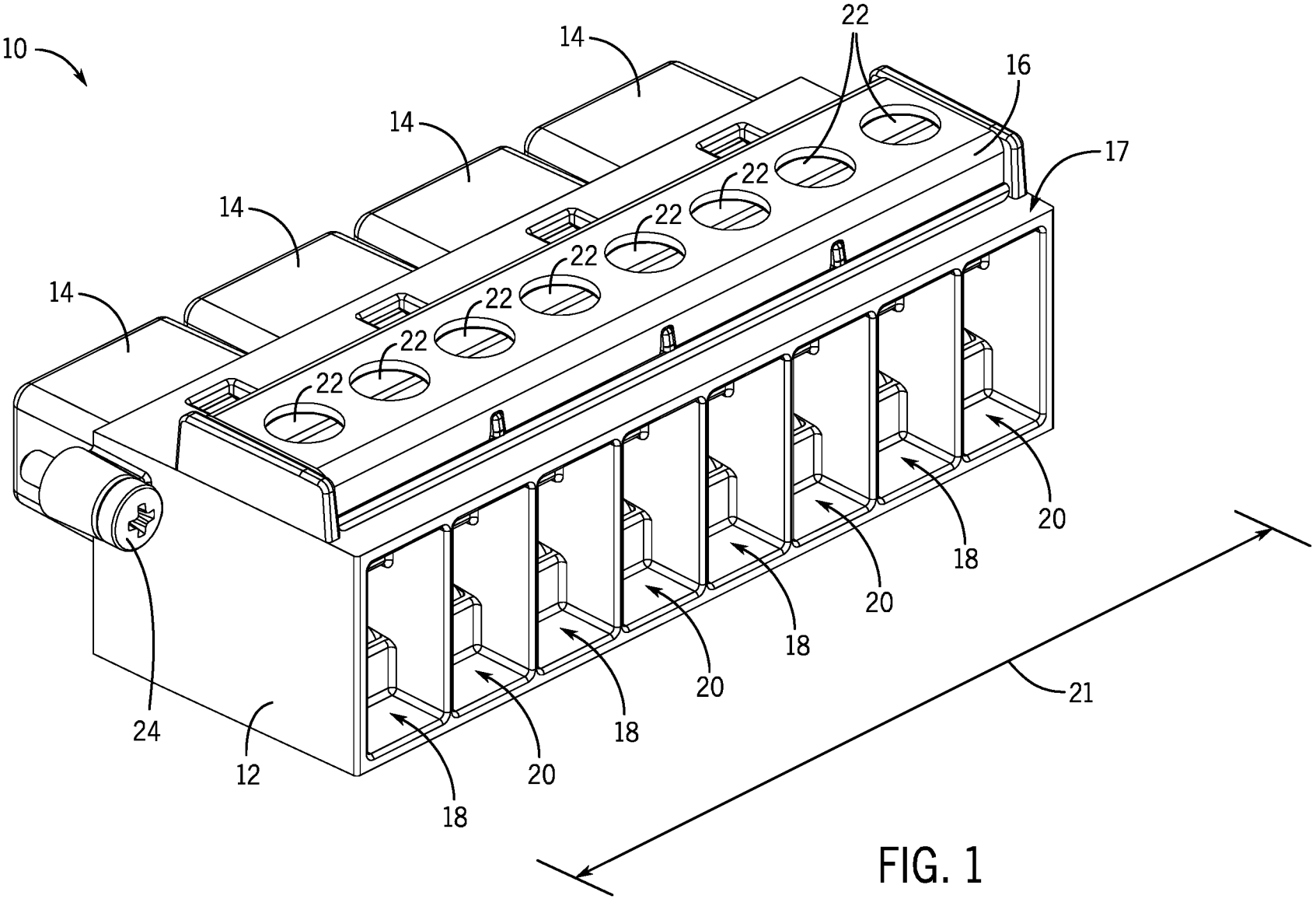
FIG. 1 is a perspective view of an example of a shorting block, in accordance with an aspect of the present disclosure.

One or more specific examples of the present disclosure will be described below. In an effort to provide a concise description of these examples, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As set forth above, current transformers may be utilized to regulate a voltage provided to a secondary power source or load (e.g., a relay, another transformer, an electronic instrument, and/or another power consuming device). For instance, a current transformer may include a primary winding electrically coupled to a high-voltage current and a secondary winding electrically coupled to the secondary power source or load. The high-voltage current of the primary winding of the current transformer may be unsuitable for operation of the secondary power source or load. As such, the current transformer may decrease the voltage in order to provide a reduced-voltage current to the secondary power source or load that is suitable for operation of the secondary power source or load.

During normal operation, the current transformer is electrically coupled to the secondary power source or load via a shorting block to form a closed loop circuit between the current transformer and the secondary power source or load. The shorting block may be utilized to disconnect (e.g., electrically isolate) the current transformer from the secondary power source or load when undergoing maintenance procedures and/or installation of various components. For instance, the shorting block may generally short circuit the current transformer by forming a closed loop between terminals of the current transformer. The shorting block may include an operating position that electrically couples the current transformer to the secondary power source or load as well as a shorting position that disconnects the current transformer from the secondary power source or load while maintaining the current transformer in a closed loop circuit (e.g., electrically coupling the terminals of the current transformer to one another).

Some shorting blocks include shorting contacts, bridging elements, and an actuator. The shorting block may include a pair of shorting contacts where a first shorting contact is electrically coupled to a first terminal of the current transformer (e.g., a first terminal associated with the secondary winding of the current transformer) and a second shorting contact is electrically coupled to a second terminal of the current transformer (e.g., a second terminal associated with the secondary winding of the current transformer). A first bridging element (e.g., a conductive bar or shunt) may be physically coupled to the first shorting contact and be configured to electrically couple the first shorting contact to a first terminal of the secondary power source or load during normal operation. Similarly, a second bridging element (e.g., a conductive bar or shunt) may be physically coupled to the second shorting contact to and be configured to electrically couple the second shorting contact to a second terminal of the secondary power source or load during normal operation.

In the operating position, the first bridging element contacts both the first shorting contact and the first terminal of the secondary power source or load and the second bridging element contacts both the second shorting contact and the second terminal of the secondary power source or load. As such, a closed loop circuit is formed between the current transformer and the secondary power source or load. To transition the shorting block from the operating position to the shorting position, the actuator or actuators (e.g., non-conductive actuators) may be inserted into the first and second shorting contacts to disengage the first and second bridging elements, respectively. The actuator or actuators remove contact between the first shorting contact, the first bridging element, and the first terminal of the secondary power source to electrically decouple the first shorting contact from the first terminal of the secondary power source. Additionally, the actuator or actuators remove contact between the second shorting contact, the second bridging element, and the second terminal of the secondary power source or load to electrically decouple the second shorting contact from the second terminal of the secondary power source or load. Further still, the actuator or actuators may simultaneously bring the first contacting element into contact with the second contacting element to form a closed loop circuit between terminals of the current transformer. As such, the current transformer is short circuited, but remains within a closed loop circuit. Unfortunately, some shorting blocks that include the shorting contacts, the bridging elements, and the actuators may have a relatively large size and be expensive to manufacture.

Accordingly, the present disclosure is directed to an improved and simplified shorting block that has shorting contacts with a reduced length and eliminates the bridging element by utilizing activation contacts (e.g., conductive activation contacts) that transition the shorting block between an operating position and a shorting position. Thus, the shorting block of the present disclosure includes a reduced size and a reduced cost because of the reduced number of components when compared to existing shorting blocks.

For instance, the shorting block may include a pair of shorting contacts configured to directly contact one another in the shorting position. The activation contacts may be inserted into the shorting contacts to form a gap between the shorting contacts (e.g., the shorting contacts do not contact one another) and place the shorting block in the operating position. As such, the activation contacts both remove contact between the pair of shorting contacts and establish an electrical connection between the pair of shorting contacts and the secondary power source or load. In some examples, the shorting contacts may include an overlapping or folded configuration that reduces a size (e.g., length) of the shorting contacts, while ensuring that the shorting contacts are in contact with one another in the shorting position and not in contact with one another in the operating position. The shorting contacts may be inserted into the shorting block as pairs, where a first shorting contact is electrically coupled to a first terminal of the current transformer (e.g., a first terminal of the secondary winding of the current transformer) and a second shorting contact is coupled to a second terminal of the current transformer (e.g., a second terminal of the secondary winding of the current transformer). The shorting contacts may be mirror images of one another, or self-similar, such that both shorting contacts function substantially the same. The shorting contacts may each include a bias that directs the shorting contacts toward one another when positioned in the shorting block. In other words, the bias of the shorting contacts urges the shorting contacts toward one another and into contact with one another. Therefore, the shorting contacts are in contact with one another as a default position upon insertion into the shorting block. As such, when the shorting contacts are in contact with one another, the first and second terminals of the current transformer form a closed loop circuit.

A first activation contact (e.g., a conductive activation contact) is electrically coupled to a first terminal of the secondary power source or load and a second activation contact (e.g., a conductive activation contact) is electrically coupled to a second terminal of the secondary power source or load. The first and second activation contacts may be inserted into the first and second shorting contacts, respectively, to direct the shorting contacts away from a direction of the bias and away from one another to form a gap between the shorting contacts. Therefore, the activation contacts electrically couple the first terminal of the current transformer to the first terminal of the secondary power source or load as well as electrically couple the second terminal of the current transformer to the second terminal of the secondary power source or load. The electrical connection formed between the activation contacts and the shorting contacts forms a closed loop circuit between the current transformer and the secondary power source or load. Therefore, insertion of the activation contacts enables the shorting block to transition from the shorting position to the activation position.

In some examples, the first activation contact may come into physical contact with the first shorting contact before the second activation contact comes into physical contact with the second shorting contact without placing the current transformer in an open circuit. For example, even though the first activation contact comes into physical contact with the first shorting contact before the second activation contact comes into physical contact with the second shorting contact, contact between the shorting contacts may be maintained because of the bias of the shorting contacts, which maintains the current transformer in a closed circuit (e.g., between the terminals of the current transformer). In short, the current transformer does not realize an open state during the transition between the shorting position and the activation position, or vice versa. Examples of the present disclosure are directed to a shorting block that includes fewer components than existing shorting blocks, includes a reduced a size when compared to existing shorting blocks, and is less expensive to manufacture when compared to existing shorting blocks.

With the foregoing in mind, FIG. 1 is a perspective view of an example of a shorting block 10, in accordance with an aspect of the present disclosure. As shown in the illustrated example of FIG. 1, the shorting block 10 includes a housing 12 that is configured to receive various components of the shorting block 10. The housing 12 may include openings configured to receive activation plugs 14. As described in detail herein, the activation plugs 14 may include apertures that receive activation contacts that ultimately transition the shorting block 10 between an operating position and a shorting position. The shorting block 10 also includes a fastener retainer 16 that covers one or more openings on a top portion 17 of the housing 12. The housing 12 has first compartments 18 and second compartments 20 that alternate along a length 21 of the housing 12. The first compartments 18 may receive electrical connectors (e.g., wires, ring terminals, or other suitable terminals) of a first terminal of a current transformer. Similarly, the second compartments 20 may receive electrical connectors (e.g., wires, ring terminals, or other suitable terminals) of a second terminal of the current transformer. The electrical connectors of the first and second terminals of the current transformer may be coupled to the shorting block 10 via fasteners 22. In some examples, the fasteners 22 may be loosened and/or tightened using a tool (e.g., a screwdriver) to facilitate coupling the electrical connectors to the shorting block 10.

In some examples, the shorting block 10 may include one or more securement fasteners 24 configured to secure the housing 12 of the shorting block 10 to another component. For example, the shorting block 10 may be positioned in an electrical cabinet and secured to the electrical cabinet and/or a component within the electrical cabinet via the one or more securement fasteners 24. The securement fasteners 24 may block movement of the shorting block 10 with respect to the electrical cabinet, which may reduce inadvertent movement of components within the housing 12 and/or reduce inadvertent disconnection of electrical components of the shorting block 10.

Figure 2:
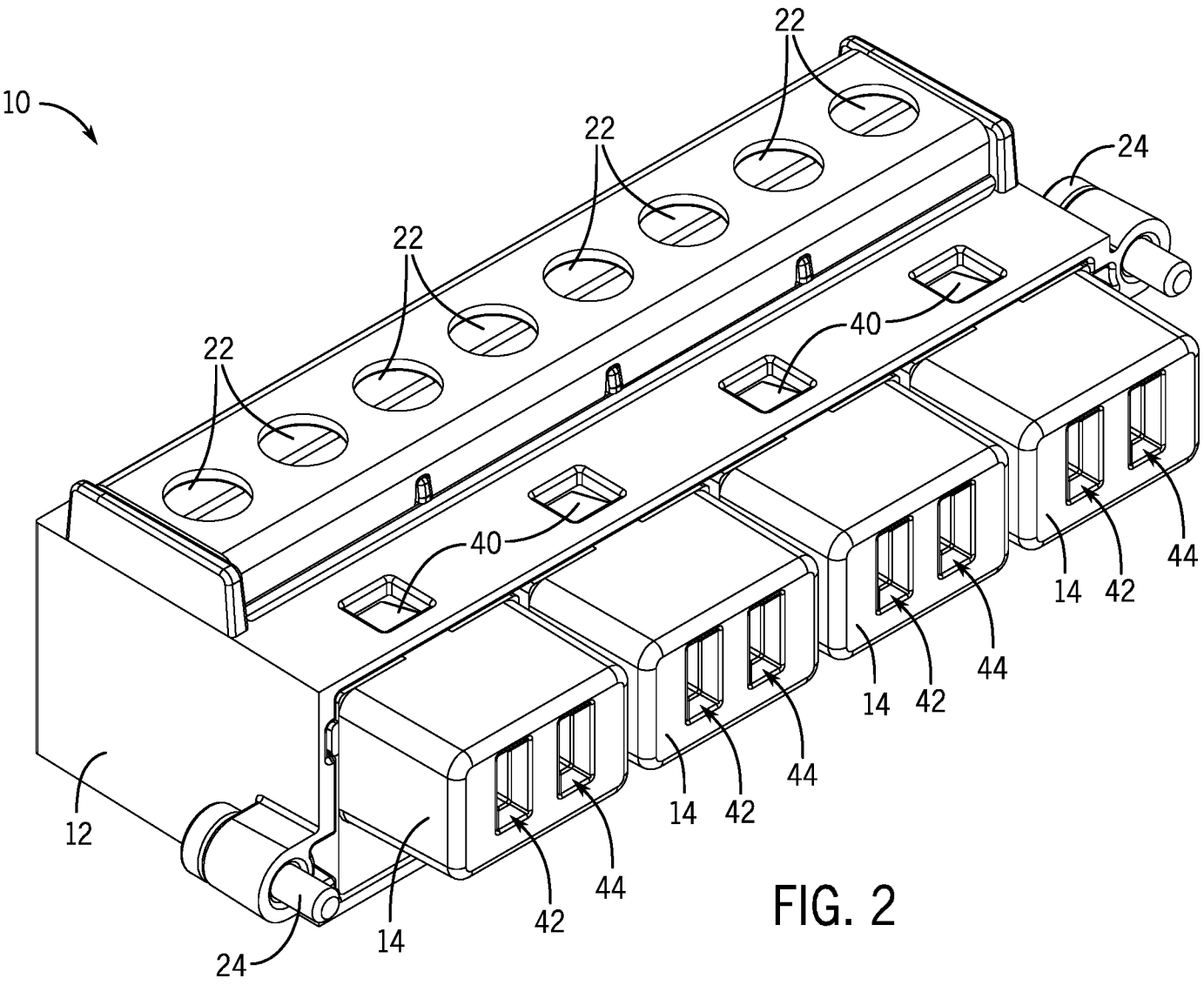
FIG. 2 is a perspective view of an example of the shorting block, in accordance with an aspect of the present disclosure.

FIG. 2 is a perspective view of the shorting block 10 illustrating the activation plugs 14 secured to the housing 12 via an interface 40. For instance, the interface 40 may include openings within the housing 12 that receive respective protrusions of the activation plugs 14. The protrusions of the activation plugs 14 may be compressed upon insertion of the activation plugs 14 into the housing 12 and then move upward into the openings upon reaching the openings. The protrusions may then secure the activation plugs 14 to the housing 12 and substantially block movement of the activation plugs 14 with respect to the housing 12.

As shown in the illustrated example of FIG. 2, the activation plugs 14 include first openings 42 and second openings 44 that may receive first activation contacts and second activation contacts, respectively. As discussed above, the first activation contacts may be electrically coupled to a first terminal of a secondary power source or load (e.g., a relay, another transformer, an electronic instrument, or another device that consumes power) and the second activation contacts may be electrically coupled to a second terminal of a secondary power source or load. Inserting the first and second activation contacts into the first and second openings 42, 44, respectively, causes the shorting block 10 to transition from a shorting position to the operating position, which establishes an electrical connection between the current transformer and the secondary power source or load. The first and second openings 42, 44 of the activation plugs 14 may guide the first and second activation contacts toward shorting contacts that are disposed within the housing 12 and facilitate the transition between the shorting position and the operating position.

Figure 3:
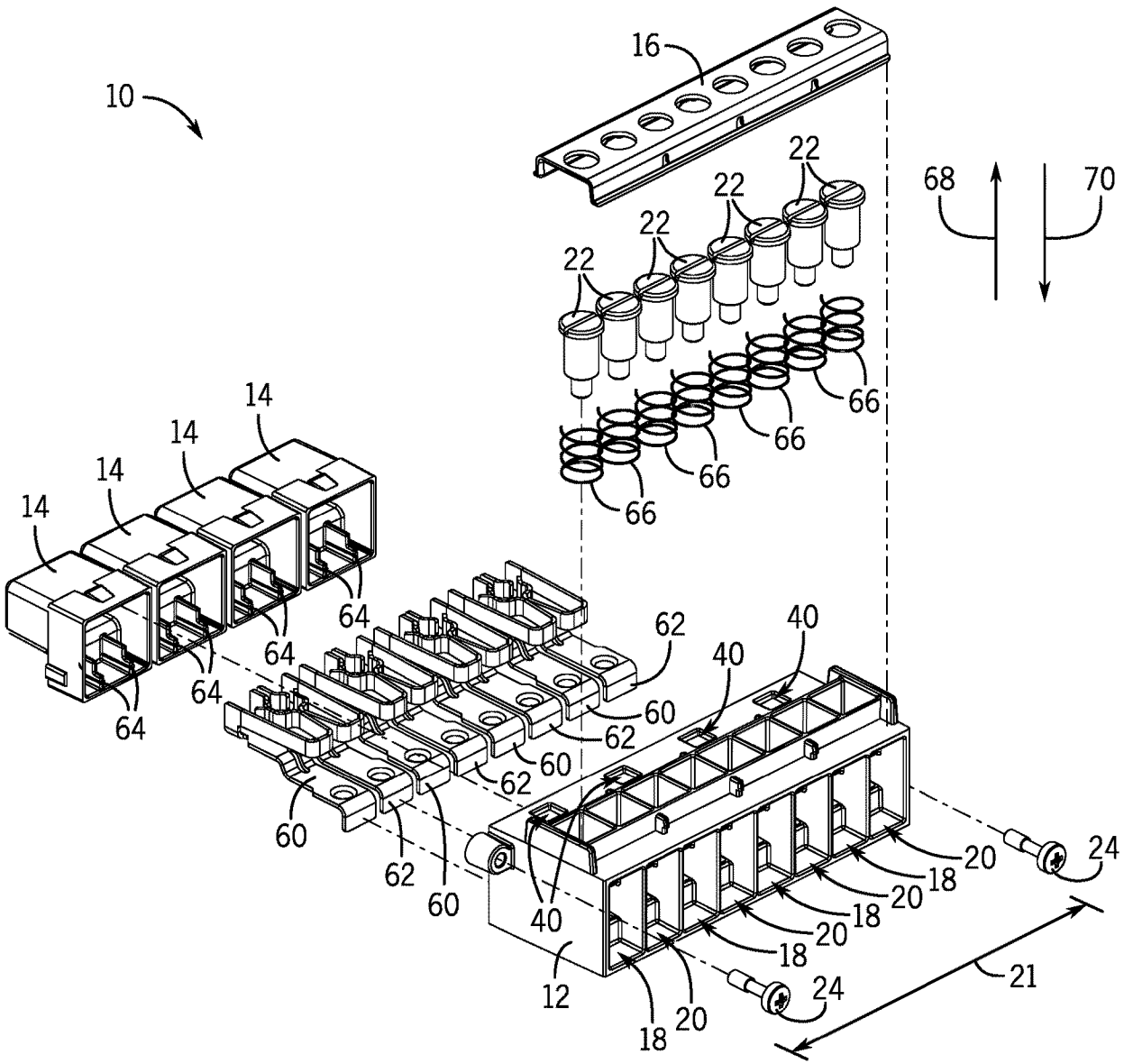
FIG. 3 is an exploded perspective view of an example of the shorting block, in accordance with an aspect of the present disclosure.
Figure 4:
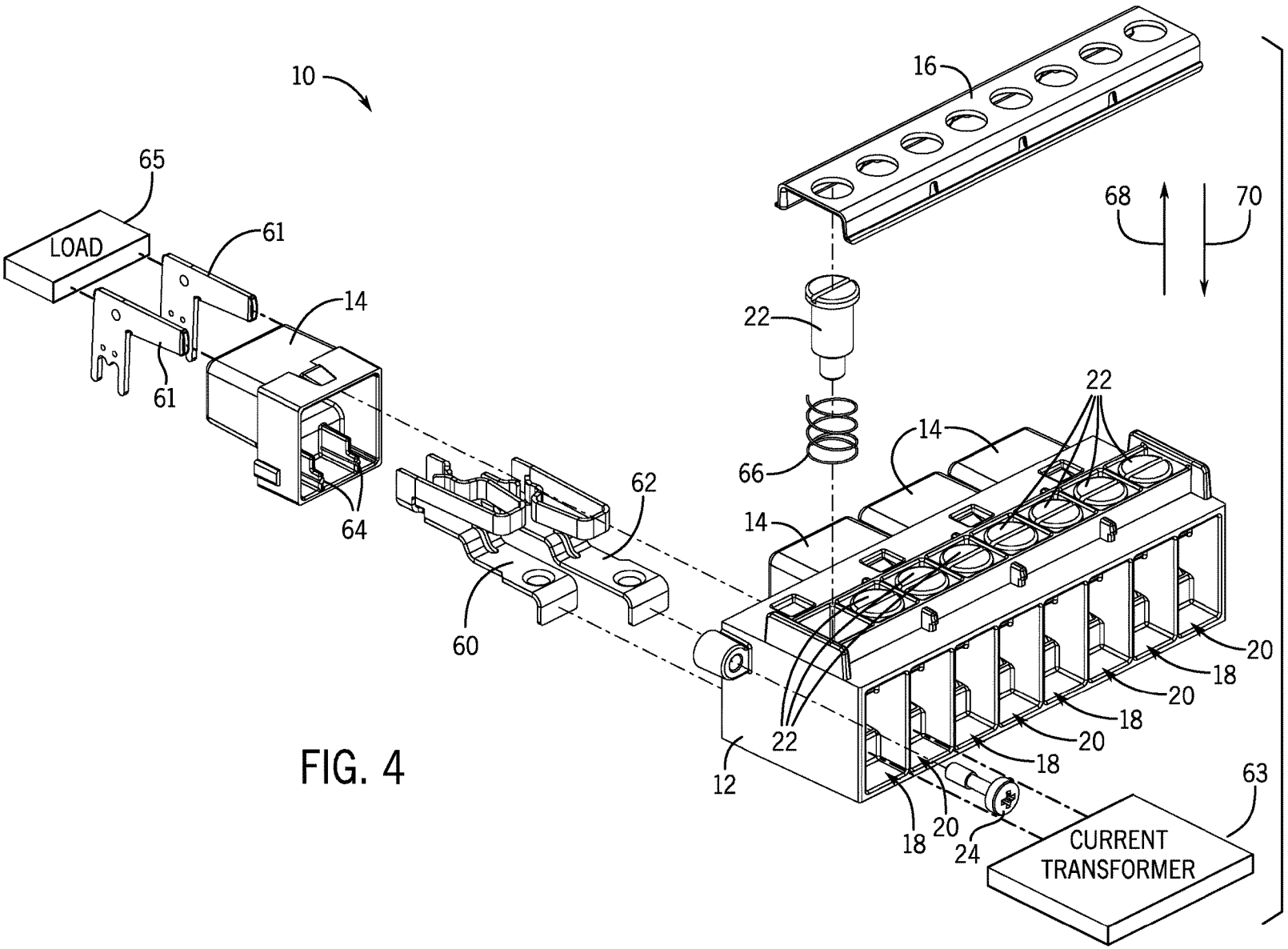
FIG. 4 is an exploded perspective view of an example of the shorting block, in accordance with an aspect of the present disclosure.

FIGS. 3 and 4 are exploded perspective views of the shorting block 10 illustrating first shorting contacts 60 and second shorting contacts 62 that are disposed within the housing 12. As shown in the illustrated example, the first and second shorting contacts 60, 62 alternate along the length 21 of the housing 12, thereby forming pairs of adjacent first and second shorting contacts 60, 62. In some examples, the first shorting contacts 60 and the second shorting contacts 62 are mirror images of one another, or self-similar. The configuration of the first and second shorting contacts 60, 62 is discussed in further detail herein with reference to FIGS. 5-10. The first and second shorting contacts 60, 62 are electrically coupled to a current transformer 63 and secured to the electrical connectors of the current transformer 63 by the fasteners 22. Thus, the first and second shorting contacts 60, 62 may include a conductive material, such as copper, copper alloy, aluminum, nickel, tin, another suitable metallic material, or any combination thereof to establish the electrical connection with the current transformer 63. Further, the first and second shorting contacts 60, 62 may be secured to or within the activation plugs 14 via support members 64. As shown in the illustrated example of FIGS. 3 and 4, the support members 64 may include protrusions extending from the activation plugs 14. As such, the support members 64 may engage the first and second shorting contacts 60, 62 and block movement of the first and second shorting contacts 60, 62 with respect to the activation plugs 14. In any case, the activation plugs 14 may receive activation contacts 61 that are electrically coupled to a load 65. As used herein, the load 65 may include any suitable device or component that receives current from the current transformer 63, such as another transformer, a relay, a power source, an electronic instrument, or any other suitable device.

In some examples, the fasteners 22 may include biasing members 66 (e.g., springs) that facilitate coupling the electrical connectors of the current transformer 63 to the first and second shorting contacts 60, 62. For example, the biasing members 66 may exert a biasing force on the fasteners 22 in a direction 68 toward the fastener retainer 16. Therefore, the fasteners 22 may abut or contact the fastener retainer 16 when the fasteners 22 are loosened or not tightened into corresponding openings of the housing 12. A gap or space may be formed between the fasteners 22 and the first and second shorting contacts 60, 62 when the fasteners 22 are abutting or contacting the fastener retainer 16, such that an electrical connector (e.g., a ring terminal) of the current transformer 63 may be disposed in the gap or space between the fasteners 22 and the first and second shorting contacts 60, 62. The fasteners 22 may then be tightened or driven away from the fastener retainer 16 in a direction 70, such that the fasteners 22 pass through openings of the electrical connectors and openings of the first and second shorting contacts 60, 62. The fasteners 22 thus secure the electrical connectors to the first and second shorting contacts 60, 62 and establish an electrical connection between the current transformer 63 and the first and second shorting contacts 60, 62.

Figure 5:
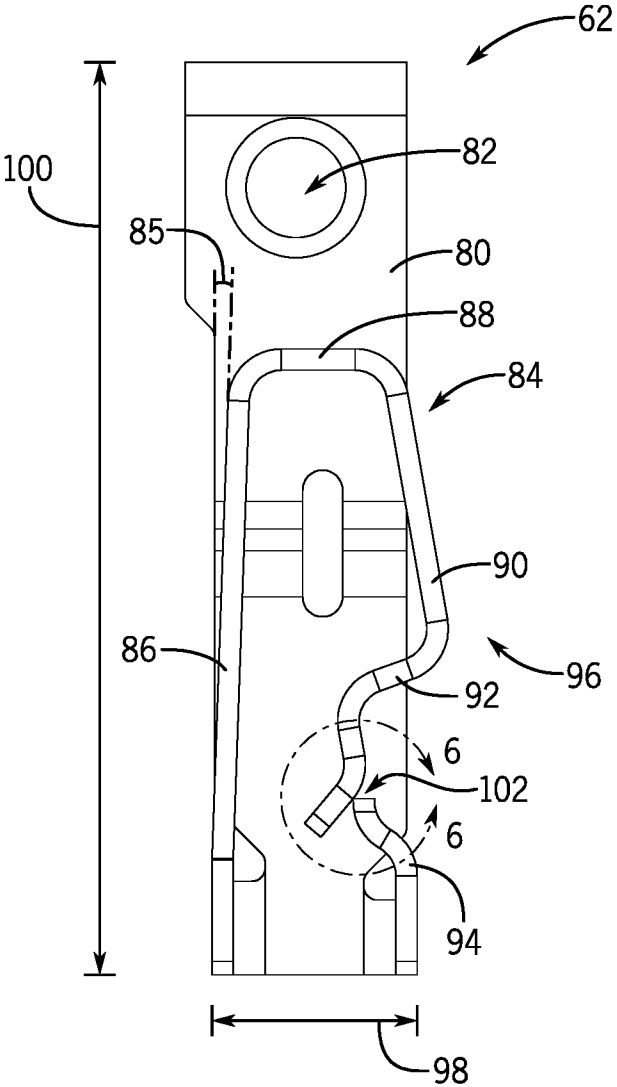
FIG. 5 is a plan view of an example of a shorting contact member of the shorting block, in accordance with an aspect of the present disclosure.

FIG. 5 is a plan view of an example of the second shorting contact 62. As shown in the illustrated example of FIG. 5, the second shorting contact 62 includes a body 80 having an opening 82. The opening 82 may receive the fastener 22 to secure the second shorting contact 62 into the housing 12 and to electrically couple the second shorting contact 62 to the electrical connector of the current transformer 63. Further, the body 80 is coupled to a shorting portion 84 of the second shorting contact 62 that is configured to enable the shorting block 10 to transition between the shorting position and the operating position.

The shorting portion 84 of the second shorting contact 62 includes an overlapping member 86, a bent portion 88, a biased portion 90, a first contact portion 92, and a second contact portion 94. As shown in the illustrated example, the overlapping member 86 is positioned at an angle 85 relative to the body 80 of the second shorting contact 62. The angle 85 of the overlapping member 86 may at least partially contribute to a bias of the biased portion 90, which enables the second shorting contact 62 to contact the first shorting contact 60 upon insertion into the housing 12 of the shorting block 10. For instance, the first shorting contact 60 is positioned on a side 96 of the second shorting contact 62 that is adjacent to the biased portion 90, and the angle 85 positions the shorting portion 84 toward the side 96 to facilitate contact between the first shorting contact 60 and the second shorting contact 62. In some examples, the angle 85 may be between 0 degrees and 20 degrees, between 1 degree and 15 degrees, or between 3 degrees and 15 degrees.

The overlapping member 86 and the biased portion 90 are coupled to one another via the bent portion 88. While the bent portion 88 has a substantially linear cross-section in the illustrated example of FIG. 5, it should be recognized that the bent portion 88 may include any suitable shape or configuration, such a semi-circle. Additionally, the configurations of the overlapping member 86 and the biased portion 90 are not limited to the configurations illustrated in FIG. 5. The bent portion 88 enables the overlapping member 86 and the biased portion 90 to substantially overlap with one another with respect to a width 98 of the second shorting contact 62. In other words, the overlapping member 86 and the biased portion 90 are generally parallel to one another with respect to a length of the body 80. In some examples, the bent portion 88 enables the second shorting contact 62 to bend back on itself, such that the overlapping member 86 and the biased portion 90 form an angle of between 160 degrees and 200 degrees, or approximately (e.g., within 10% of, within 5% of, or within 1% of) 180 degrees, with one another. Further, by the second shorting contact 62 bending back on itself, the bend portion 88 allows the activation and deactivation to be performed via insertion of a male contact. Forming the overlap between the overlapping member 86 and the biased portion 90 with respect to the width 98 of the second shorting contact 62 enables the length 100 of the second shorting contact 62 to be reduced.

In some examples, the first contact portion 92 and the second contact portion 94 are in contact with one another at a contact point 102 before the second shorting contact 62 is disposed within the housing 12 of the shorting block 10. As such, contact between the first shorting contact 60 and the second shorting contact 62 may direct the first contact portion 92 away from the second contact portion 94 and form a gap between the first contact portion 92 and the second contact portion 94. In other examples, the gap between the first contact portion 92 and the second contact portion 94 may be formed prior to disposal of the second shorting contact 62 into the housing 12 of the shorting block 10. As such, the gap may increase in size due to contact between the first shorting contact 60 and the second shorting contact 62 upon assembly of the shorting block 10. The gap between the first contact portion 92 and the second contact portion 94 may facilitate insertion of an activation contact 61 between the first contact portion 92 and the second contact portion 94. In some embodiments, shorting of the shorting block 10 may be integrated into the first shorting contact 60 and the second shorting contact 62 such that shorting occurs prior to insertion and following removal of an activation contact between the first shorting contact 60 and the second shorting contact 62. In still further embodiments, the second contact portion 94 of the second shorting contact 62 may be eliminated, such that the activation contact 61 is configured to establish an electrical connection with only the first contact portion 92.

Figure 6:
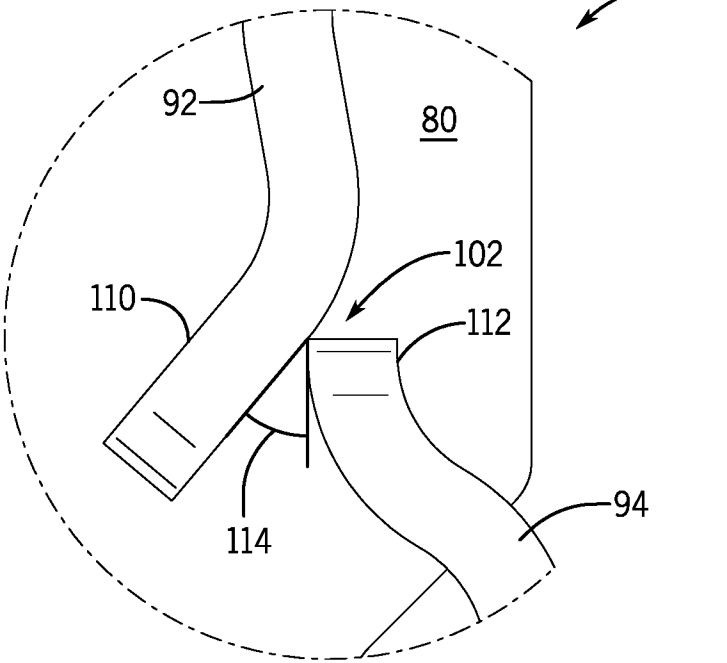
FIG. 6 is an expanded view of an example of a first contact portion and a second contact portion of the shorting contact member, in accordance with an aspect of the present disclosure.

FIG. 6 is an expanded view of the contact point 102 between the first contact portion 92 and the second contact portion 94. As shown in the illustrated example of FIG. 6, the first contact portion 92 includes an extension 110, which may be utilized to contact and guide the activation contact 61 into the gap between the first contact portion 92 and the second contact portion 94. Additionally or alternatively, the extension 110 and an end 112 of the second contact portion 94 may form an angle 114 at the contact point 102. In some examples, the angle 114 between the extension 110 of the first contact portion 92 and the end 112 of the second contact portion 94 is between 20 degrees and 90 degrees, between 25 degrees and 60 degrees, or between 30 degrees and 45 degrees. In other examples, the angle 114 may be any suitable angle that is configured to facilitate insertion of the activation contact 61 between the first contact portion 92 and the second contact portion 94 and to maintain contact between the first contact portion 92, the activation contact 61, and the second contact portion 94 when in the operating position.

Figure 7:
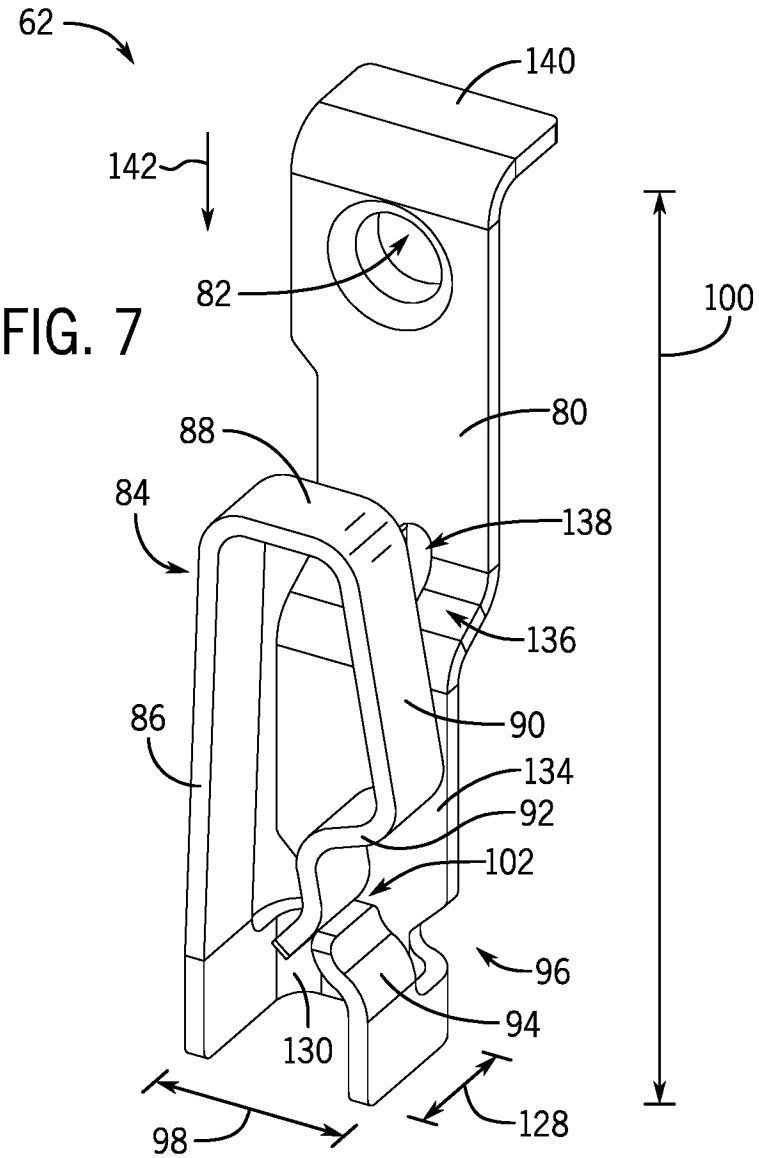
FIG. 7 is a perspective view of an example of the shorting contact member of the shorting block, in accordance with an aspect of the present disclosure.

FIG. 7 is a perspective view of an example of the second shorting contact 62 illustrating the shorting portion 84 of the second shorting contact 62 offset from the body 80 of the second shorting contact 62 with respect to a thickness 128 of the second shorting contact 62. As such, the shorting portion 84 may move independently from the body 80, which is configured to be secured to the housing 12 of the shorting block 10. In other words, the offset between the shorting portion 84 and the body 80 enables the first contact portion 92 and the second contact portion 94 of the second shorting contact 62 to move with respect to the housing 12 of the shorting block 10. The shorting portion 84 is coupled to the body 80 via a base portion 130. In some examples, the base portion 130 is configured to form the offset between the shorting portion 84 and the body 80. Additionally, or alternatively, the base portion 130 may be inserted into a plug that is disposed in the housing 12. Therefore, the base portion 130 may also be secured with respect to the plug and the housing 12, which also facilitates movement of the first contact portion 92 and the second contact portion 94 with respect to the base portion 130 and/or the body 80.

In some examples, the body 80 may have a raised portion 134 formed by a transition portion 136 of the body 80. The raised portion 134 and/or the transition portion 136 may enable the body 80 to be further secured to the activation plug 14 and/or to accommodate other adjacent features of the shorting block 10. For instance, the transition portion 136 may include an aperture 138 that is configured to at least partially receive the support member 64 of the activation plug 14. The raised portion 134 allows the body 80 to conform to the support member 64, and in some examples, contact a top portion of the support member 64. In other words, the raised portion 134 enables the support member 64 to be at least partially disposed in the aperture 138 without obstructing the second shorting contact 62 within the activation plug 14.

Additionally, the second shorting contact 62 includes a lip 140 that may further secure the second shorting contact 62 within the housing 12. For example, the lip 140 is configured to abut a protrusion, ledge, or other suitable feature within the housing 12 to block movement of the second shorting contact 62 in a direction 142 along the length 100 of the second shorting contact 62. Therefore, the lip 140 further secures the second shorting contact 62 within the housing 12, thereby reducing inadvertent movement of the second shorting contact 62 with respect to the housing 12 and/or inadvertent interruption of an electrical connection between the second shorting contact 62 and the current transformer 63.

Figure 8:
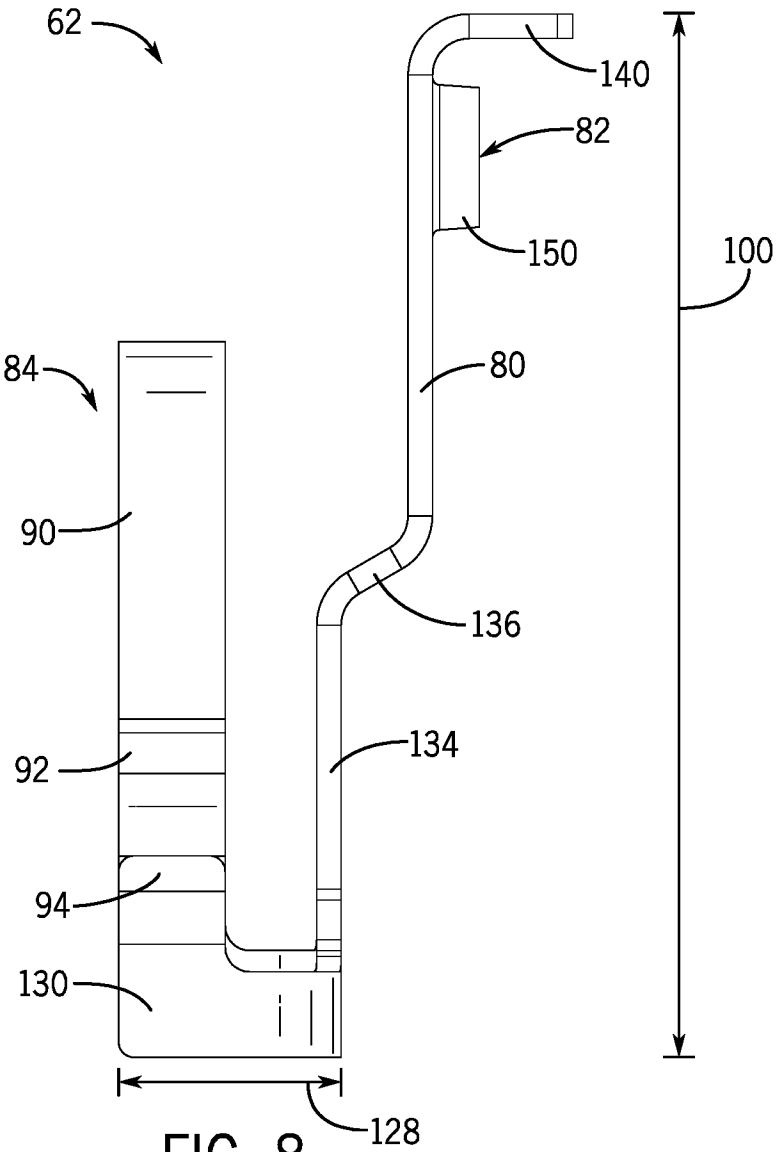
FIG. 8 is an elevation view of an example of the shorting contact member of the shorting block, in accordance with an aspect of the present disclosure.

FIG. 8 is an elevation view of the second shorting contact 62 further illustrating the offset between the body 80 and the shorting portion 84 with respect to the thickness 128 of the second shorting contact. As set forth above, the offset may enable movement of the biased portion 90, the first contact portion 92, and/or the second contact portion 94 with respect to the body 80. As such, the body 80 may be secured to the housing 12 and/or the activation plug 14 while the biased portion 90, the first contact portion 92, and/or the second contact portion 94 may move with respect to the housing 12 and/or the activation plug 14. In some examples, the opening 82 in the body 80 of the second shorting contact 62 includes a ridge 150 that is configured to be disposed within a corresponding opening in the housing 12. For instance, as discussed above, the fastener 22 may extend through the opening 82, through an opening of the electrical connector of the current transformer 63, and into a corresponding opening of the housing 12 to electrically couple the second shorting contact 62 to the current transformer 63. Positioning the ridge 150 within the corresponding opening of the housing 12 may further secure the body 80 to the housing 12 and ensure a sufficient electrical connection between the second shorting contact 62 and the current transformer 63 when the fastener 22 is disposed in the corresponding opening of the housing 12.

Figure 9:
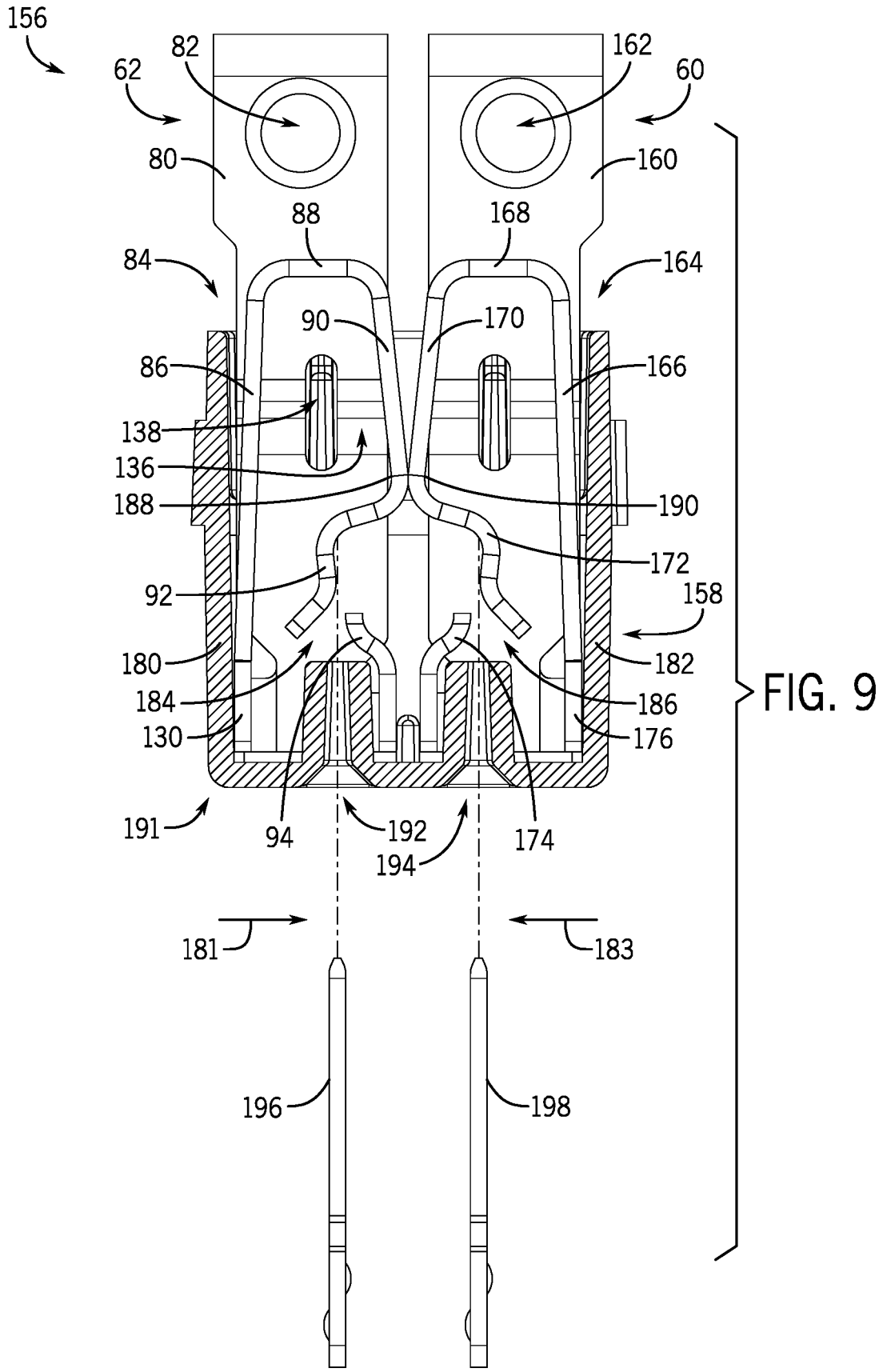
FIG. 9 is a plan view of an example of a shorting assembly of the shorting block in a shorting position, in accordance with an aspect of the present disclosure.

In some examples, disposing the first shorting contact 60 and the second shorting contact 62 into the housing may cause the first and second shorting contacts 60, 62 to be in a shorting position. For instance, FIG. 9 is a plan view of an example of a shorting assembly 156 of the shorting block 10 having the first shorting contact 60 and the second shorting contact 62 in a plug 158. In some examples, the plug 158 may be formed integrally with the housing 12. In other examples, the plug 158 may be a separate component from the housing and coupled to the housing 12 via a weld, a fastener, a clamp, and/or another suitable securement feature. The plug 158 may include a temperature resistant material such as nylon, nylon having a glass filler (e.g., 30% glass filler), or another suitable material. As shown in the illustrated example of FIG. 9, the first shorting contact 60 is substantially a mirror-image of the second shorting contact 62 (e.g., the first shorting contact 60 and the second shorting contact 62 are self-similar). Thus, the first shorting contact 60 also includes a body 160 having an opening 162 configured to facilitate coupling the first shorting contact 60 to the current transformer 63 (e.g., an electrical connector of the current transformer 63). Further, the first shorting contact 60 includes a shorting portion 164 having an overlapping member 166, a bent portion 168, a biased portion 170, a first contact portion 172, and a second contact portion 174. Further, the shorting portion 164 of the first shorting contact 60 may be coupled to the body 160 via a base portion 176.

The base portion 130 of the second shorting contact 62 and the base portion 176 of the first shorting contact 60 may be disposed within the plug 158. In some examples, a first wall 180 of the plug 158 secures the base portion 130 and blocks movement of the body 80 of the second shorting contact 62. Further, the first wall 180 may apply an opposing force to the base portion 130 in a direction 181 that is opposite of a force applied to the shorting portion 84 by the first shorting contact 60. Similarly, the plug 158 may include a second wall 182 that is configured to secure the base portion 176 and block movement of the body 160 of the first shorting contact 60. Further, the second wall 182 may apply an opposing force to the base portion 176 that is in a direction 183 that is opposite of a force applied to the shorting portion 164 by the second shorting contact 62. As shown in the illustrated example of FIG. 9, the base portions 130, 176 contact a relatively small portion of the plug 158. While the walls 180, 182 of the plug 158 apply an opposing force to the base portions 130, 176 a load or stress on the plug 158 is relatively low. Therefore, the operating life of the plug 158 may be increased as due to relatively little wear experienced by the plug 158.

Accordingly, the opposing forces applied by the walls 180, 182 enable the shorting portions 84, 164 to contact one another and apply opposing forces to one another. The opposing forces applied to the shorting portions 84, 164 may be sufficient to drive movement of the first contact portions 92, 172 away from the second contact portions 94, 174, respectively. Accordingly, a first gap 184 may be formed between the first contact portion 92 and the second contact portion 94 of the second shorting contact 62 and a second gap 186 may be formed between the first contact portion 172 and the second contact portion 174 of the first shorting contact 60. In some examples, the gap 184 and/or the gap 186 may facilitate insertion of the activation contacts 61 between the first contact portions 92, 172, and the second contact portions 94, 174, respectively. Additionally, the opposing forces applied by the walls 180, 182 establish contact between the shorting portion 84 and the shorting portion 164 at a contact point 188 of the second shorting contact 62 and a contact point 190 of the first shorting contact 60. Therefore, an electrical connection is established between the first shorting contact 60 (e.g., coupled to a first terminal of the current transformer 63) and the second shorting contact 62 (e.g., coupled to a second terminal of the current transformer 63) to form a closed loop circuit between the first terminal of the current transformer 63 and the second terminal of the current transformer 63. The shorting block 10 is thus in a shorting position 191 when the first shorting contact 60 and the second shorting contact 62 are disposed within the plug 158 and the housing 12.

As shown in the illustrated example of FIG. 9, the plug 158 includes a first opening 192 and a second opening 194 to enable access to the second shorting contact 62 and the first shorting contact 60, respectively, from outside of the plug 158. To transition the shorting block 10 to an operating position, a first activation contact 196 and a second activation contact 198 may be inserted into the first opening 192 and the second opening 194, respectively, to engage the second shorting contact 62 and the first shorting contact 60. The first activation contact 196 is electrically coupled to a first terminal or connection of the load 65 and the second activation contact 198 is electrically coupled to a second terminal or connection of the load 65. As such, the first activation contact 196 and the second activation contact 198 include a conductive material that establishes the electrical connection between the current transformer 63 and the load 65. In some examples, the first activation contact 196 and the second activation contact 198 include copper, copper alloy, aluminum, nickel, tin, another suitable metallic material, or any combination thereof. In other examples, the first activation contact 196 and the second activation contact 198 may include any suitable conductive material.

Figure 10:
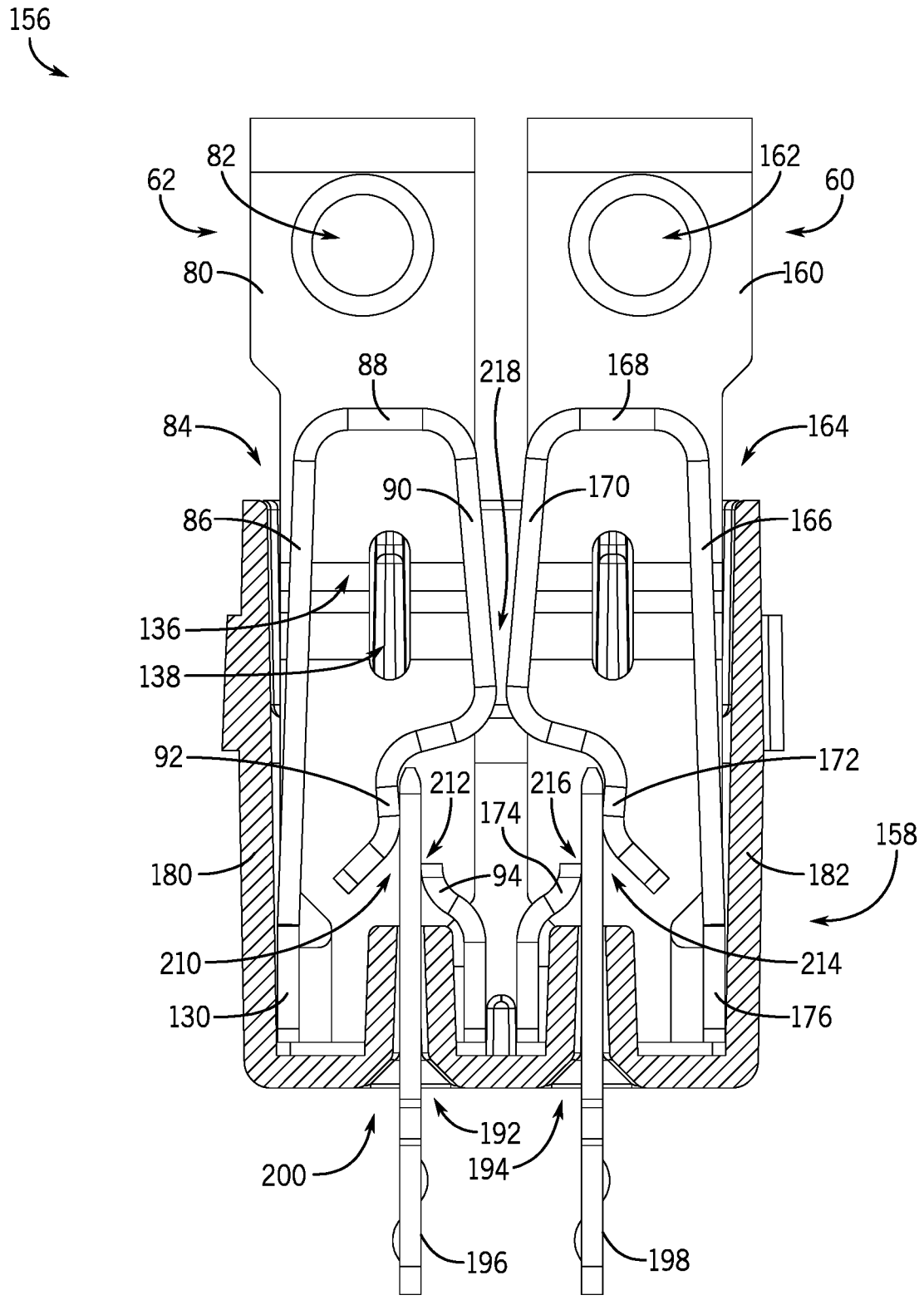
FIG. 10 is a plan view of an example of the shorting assembly of the shorting block in an operating position, in accordance with an aspect of the present disclosure.

FIG. 10 is a plan view of the shorting assembly 156 in an operating position 200. As shown in the illustrated example of FIG. 10, the first activation contact 196 and the second activation contact 198 are disposed within the first opening 192 and the second opening 194, respectively. The first activation contact 196 engages the second shorting contact 62 and contacts the first contact portion 92 at a contact point 210 and contacts the second contact portion 94 at contact point 212. As such, an electrical connection is established between the first activation contact 196 and the second shorting contact 62 via the first contact portion 92 and the second contact portion 94. Similarly, the second activation contact 198 is electrically coupled to the first shorting contact 60 via a contact point 214 with the first contact portion 172 and a contact point 216 with the second contact portion 174

Additionally, when the first activation contact 196 and the second activation contact 198 are engaged with the second shorting contact 62 and the first shorting contact 60, respectively, a gap 218 is formed between the second shorting contact 62 and the first shorting contact 60. In other words, the contact point 188 of the second shorting contact 62 and the contact point 190 of the first shorting contact 60 are not in contact with one another to form the gap 218. As set forth above, the first activation contact 196 and the second activation contact 198 are both electrically coupled to the load 65, and thus, a closed loop circuit is formed between the current transformer 63 and the load 65 when the shorting block 10 is in the operating position 200.

Further still, the current transformer 63 is maintained within a closed loop circuit during insertion of the first activation contact 196 and the second activation contact 198. As a non-limiting example, in some cases, the first activation contact 196 may contact or otherwise engage the second shorting contact 62 before the second activation contact 198 contacts or engages the first shorting contact 60. As such, the first activation contact 196 may be electrically coupled to the first contact portion 92 and/or the second contact portion 94 before the second activation contact 198 contacts one or both of the first contact portion 172 and the second contact portion 174 of the first shorting contact 60. However, the current transformer 63 remains within a closed loop circuit because the contact point 188 of the second shorting contact 62 maintains contact with the contact point 190 of the first shorting contact 60. In other words, the first activation contact 196 may begin to urge the second shorting contact 62 away from the first shorting contact 60, but the biasing force of the shorting portion 164 of the first shorting contact 60 may continue to urge the first shorting contact 60 toward the second shorting contact 62 and maintain contact. Therefore, a closed loop is maintained between the first and second terminals of the current transformer 63 despite the second activation contact 198 not being in contact with the first shorting contact 60. The shorting block of the present disclosure thus enables the current transformer 63 to remain within a closed loop circuit throughout the entire transition between the shorting position and the operating position, and vice versa. The shorting block thus includes a make before break connection, which enables current flow to remain uninterrupted throughout transitions between the shorting position and the operating position.

Figure 11:
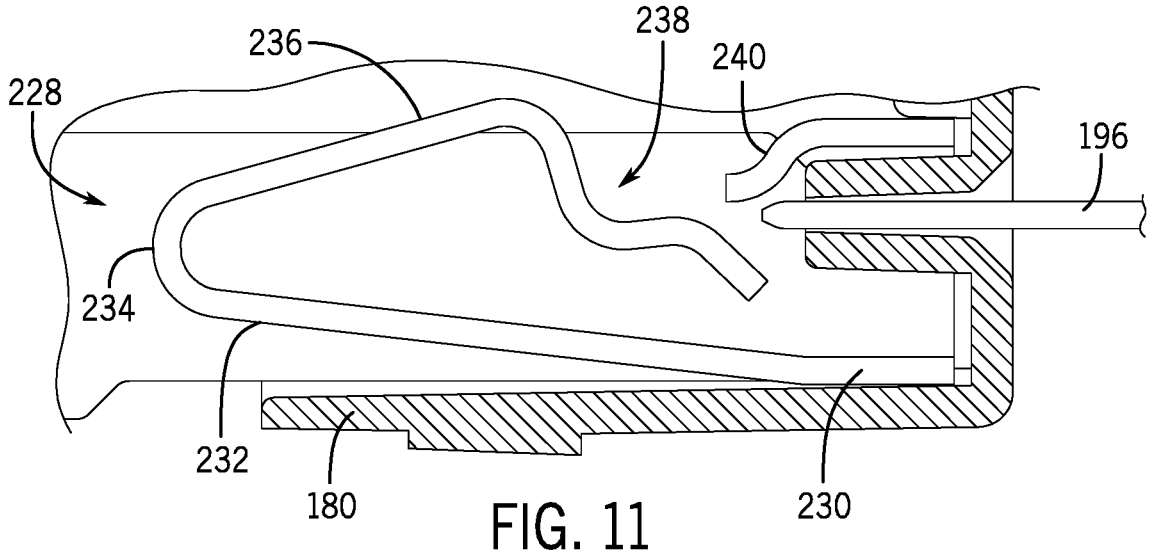
FIG. 11 is a plan view of an example of the shorting contact member of the shorting block, in accordance with an aspect of the present disclosure.

While the examples of FIGS. 3-10 illustrate the first and second shorting contacts 60, 62 having a specific configuration, in other examples, the first and second shorting contacts 60, 62 may include other suitable shapes and designs. For example, FIG. 11 is a plan view of an example of a shorting contact 228 that may be utilized with the shorting block 10, in accordance with an aspect of the present disclosure. As shown in the illustrated example of FIG. 11, the shorting contact 228 includes a base portion 230, which may be inserted and secured within the plug 158. Further, the shorting contact 228 includes an overlapping member 232, a curved portion 234, a biased portion 236, a first contact portion 238, and a second contact portion 240. As shown in the illustrated example of FIG. 11, the shorting contact 228 includes a curved portion 234 having a generally semi-circular cross-section instead of the bent portion 88 that included a substantially linear cross-section. While the shorting contact 228 includes a different configuration (e.g., shape) than the first and second shorting contacts 60, 62, it should be recognized that the shorting contact 228 may function substantially the same as the first and second shorting contacts 60, 62. In other words, the shorting contact 228 may cooperate with a corresponding shorting contact that is a mirror image of the shorting contact 228. Additionally, the first activation contact 196 may be utilized to transition the shorting contact 228 (and the corresponding shorting contact) between the shorting position and the operating position.

Figure 12:
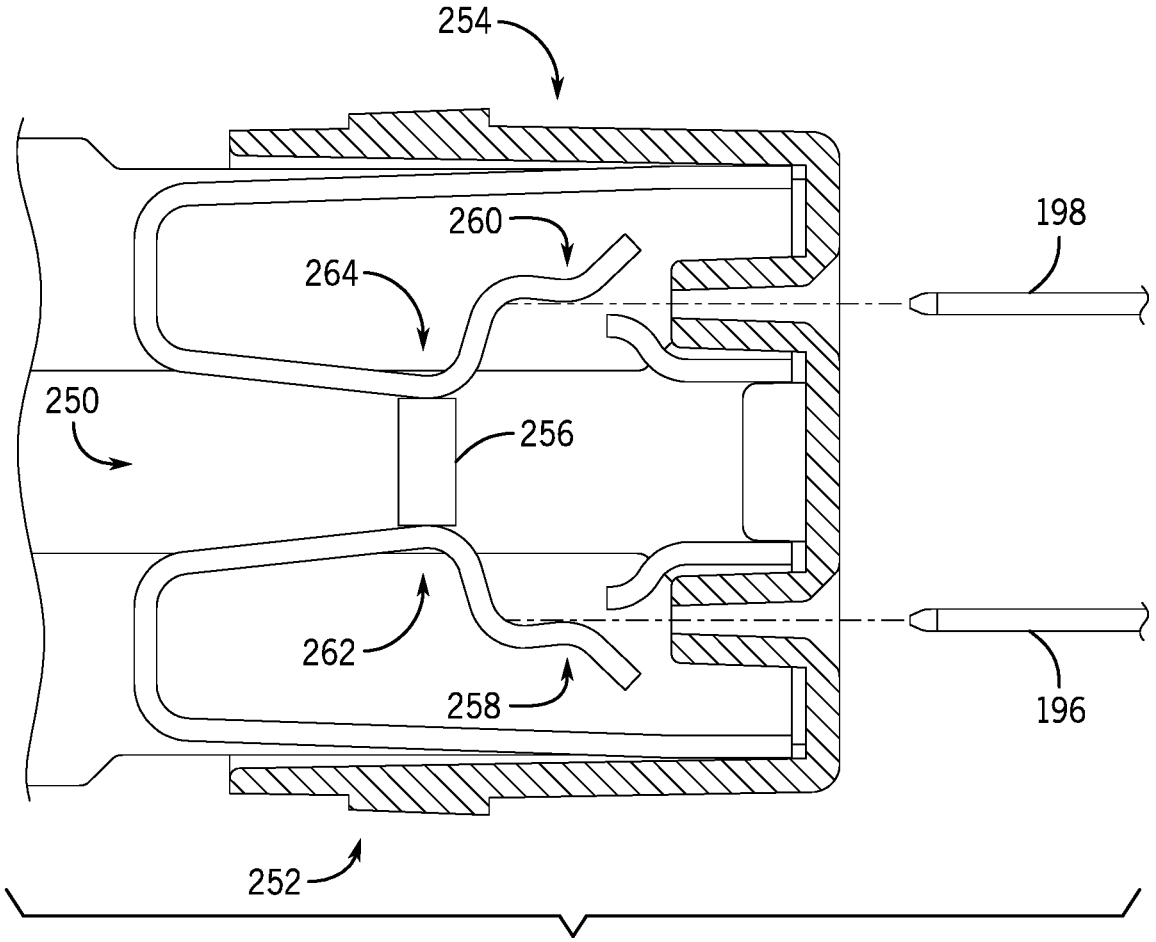
FIG. 12 is a plan view of an example of the shorting assembly of the shorting block having a shorting bar, in accordance with an aspect of the present disclosure.

In still further examples, the shorting block 10 may include a shorting bar in addition to, or in lieu of, direct contact between shorting contacts. For example, FIG. 12 is a plan view of an example of a shorting assembly 250 that includes a first shorting contact 252, a second shorting contact 254, and a shorting bar 256. In some examples, the shorting bar 256 is physically coupled (e.g., welded or fastened) to the first shorting contact 252 or the second shorting contact 254. The shorting bar 256 may be in contact with both the first shorting contact 252 and the second shorting contact 254 when the first shorting contact 252 and the second shorting contact 254 are disposed within the plug 158 and/or the housing 12 of the shorting block 10. As such, the shorting assembly 250 may be in the shorting position (e.g., electrically coupling the first and second terminals of the current transformer 63) as a default upon insertion of the first shorting contact 252 and the second shorting contact 254 into the housing 12.

As shown in the illustrated example of FIG. 12, the first shorting contact 252 includes a first receiving portion 258 and the second shorting contact includes a second receiving portion 260. The first receiving portion 258 is coupled to a first contact portion 262 of the first shorting contact 252 and the second receiving portion 260 is coupled to a second contact portion 264 of the second shorting contact 254. The first and second contact portions 262, 264 may include segments of the first and second shorting contacts 252, 254 that contact the shorting bar 256 and establish a direct electrical connection between the first and second shorting contacts 252, 254. The activation contacts 196, 198 may be disposed in the first and second receiving portions 258, 260 to drive the first and second contact portions 262, 264 away from one another, such that the shorting bar 256 does not contact at least one of the first shorting contact 252 or the second shorting contact 254. Accordingly, upon insertion of the first and second activation contacts 196, 198, the current transformer 63 may be in a closed loop circuit with the load 65 via the first shorting contact 252, the second shorting contact 254, the first activation contact 196, and the second activation contact 198.

Figure 13:
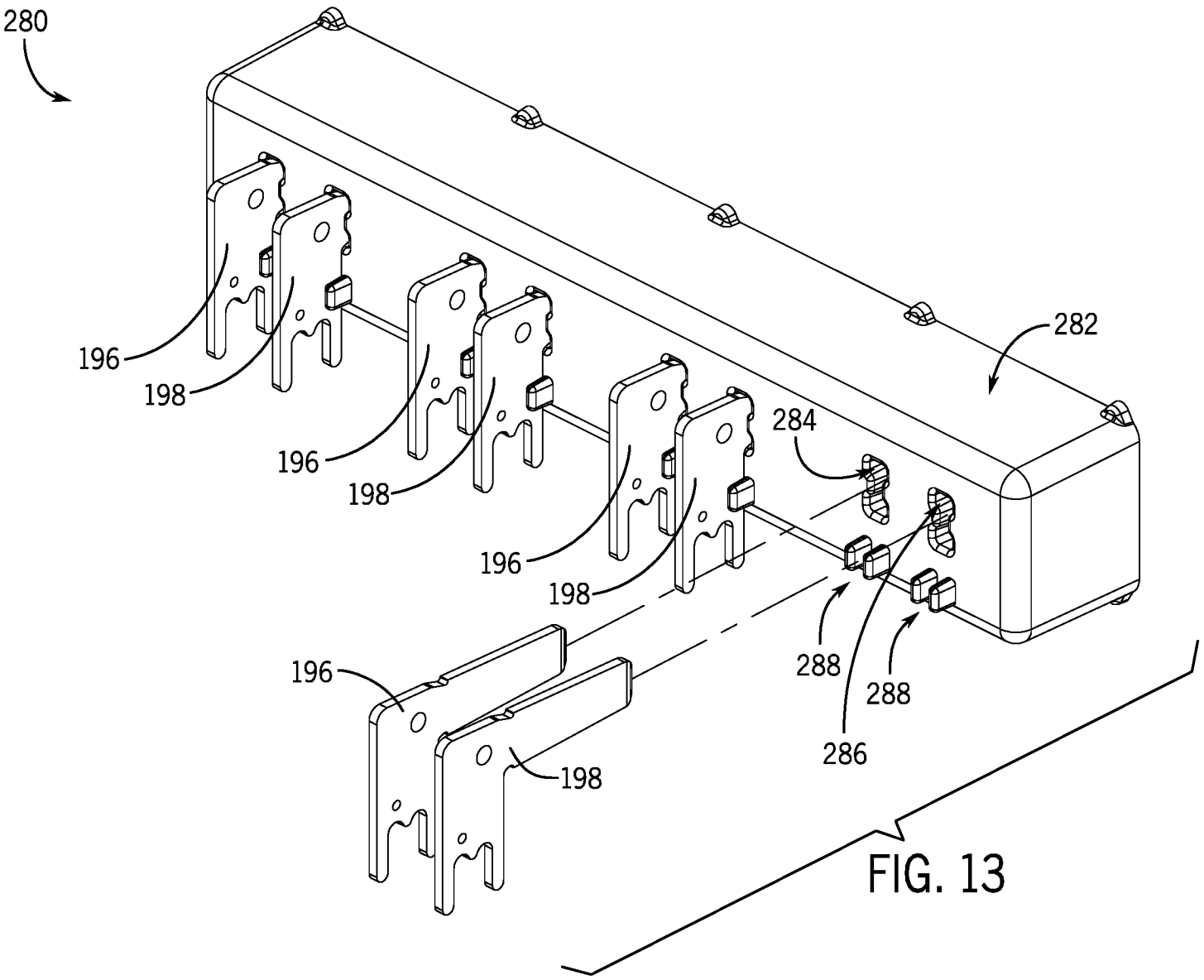
FIG. 13 is a perspective view of an example of an activation header for the shorting block, in accordance with an aspect of the present disclosure.

In some examples, the shorting block 10 may include an integrated activation header 280 that facilitates transitioning multiple shorting assemblies 156 between the shorting position 191 and the operating position 200. For example, FIG. 13 is a perspective view of an example of the integrated activation header 280 that may receive and/or secure a plurality of first activation contacts 196 and a plurality of second activation contacts 198. The integrated activation header 280 includes a housing 282 having first openings 284 configured to receive first activation contacts 196 and second openings 286 configured to receive second activation contacts 198. The first and second activation contacts 196, 198 extend through the first and second openings 284, 286 of the integrated activation header 280 and ultimately pass through the first and second openings 192, 194 of the plug 158 to engage the first and second shorting contacts 60, 62, for example.

Further, the housing 282 of the integrated activation header 280 may include securement features 288 that may engage and secure the first and second activation contacts 196, 198 to the housing 282. In some examples, the securement features 288 include protrusions that may clamp around at least a portion of the first and second activation contacts 196, 198 and secure the first and second activation contacts 196, 198 to the housing 282. For example, the securement features 288 may couple to the first and second activation contacts 196, 198 via a friction interference fit that substantially blocks movement of the first and second activation contacts 196, 198 with respect to the housing 282. Accordingly, the securement features 288 may reduce inadvertent movement of the first and second activation contacts 196, 198, and thus, inadvertent interruption of an electrical connection between the load 65 and the first and second activation contacts 196, 198.

Figure 14:
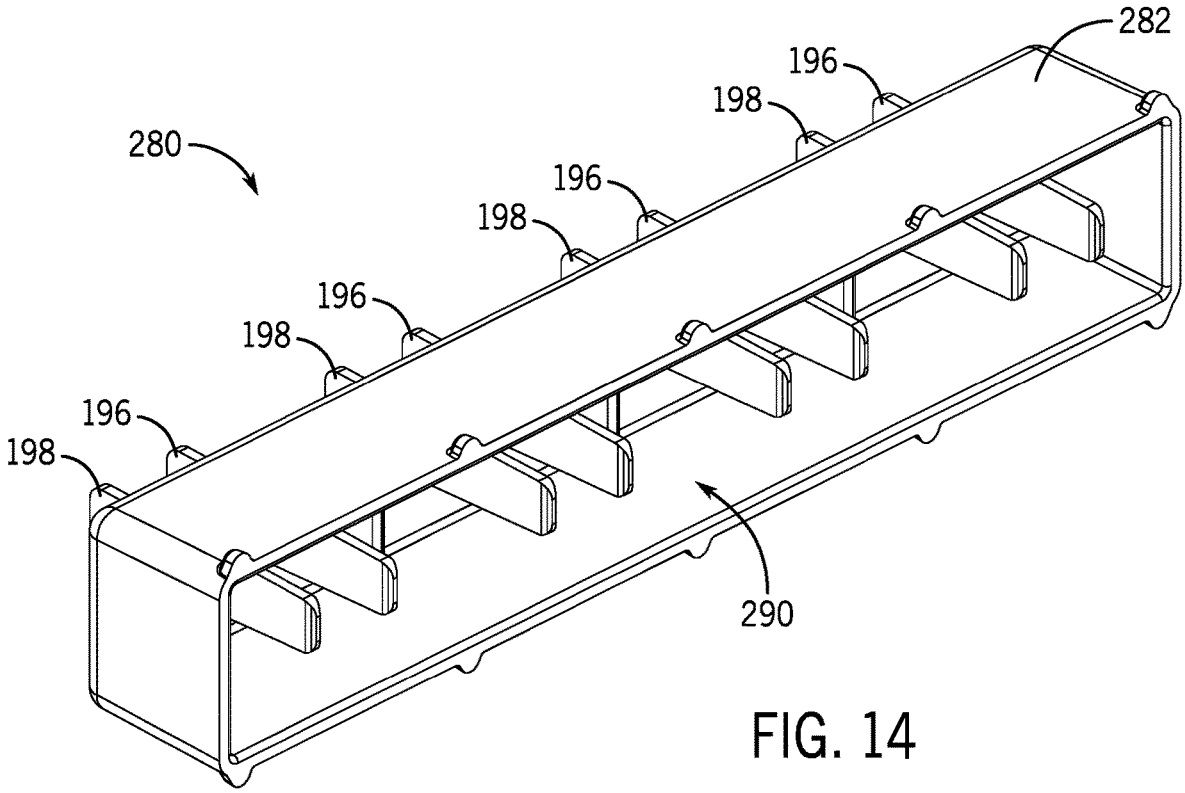
FIG. 14 is a perspective view of an example of the activation header for the shorting block, in accordance with an aspect of the present disclosure.

FIG. 14 is a perspective view of the integrated activation header 280 illustrating an opening 290 that receives the activation plugs 14, or in other examples, directly interface with the plugs 158. As shown in the illustrated example, the first and second activation contacts 196, 198 extend into the opening 290, and thus, may be inserted into the openings 42, 44 of the activation plugs 14 and/or the openings 192, 194 of the plugs 158. In some examples, each set of the first and second activation contacts 196, 198 may be inserted into a corresponding plug 158 substantially simultaneously using the integrated activation header 280. In other examples, each set of the first and second activation contacts 196, 198 may be independently inserted and/or removed from the first and second openings 284, 286 of the integrated activation header 280.

Figure 15:
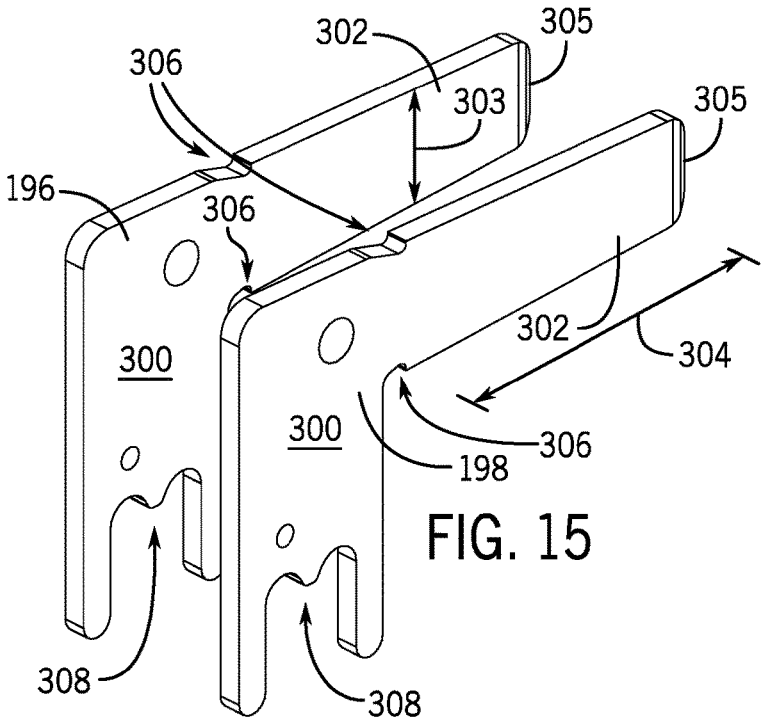
FIG. 15 is a perspective view of activation contacts of the shorting block, in accordance with an aspect of the present disclosure.

In some examples, the first and second activation contacts 196, 198 may include various features that facilitate coupling the first and second activation contacts 196, 198 to the first and second shorting contacts 60, 62, the activation plugs 14, and/or the integrated activation header 280. For example, FIG. 15 is a perspective view of the first activation contact 196 and the second activation contact 198. As shown in the illustrated example of FIG. 15, the first and second activation contacts 196, 198 each include a body portion 300 and an activation portion 302 extending from the body portion 300. In some examples, the activation portion 302 is tapered or has a height 303 gradually reduces along a length 304 of the activation portion 302. Tapering the activation portion 302 may facilitate insertion of the first and second activation contacts 196, 198 into the openings 42, 44 of the activation plugs 14, the openings 192, 194 of the plugs 158, and/or the openings 284, 286 of the integrated activation header 280. Further, the activation portion 302 may include tapered ends 305 that further facilitate insertion of the first and second activation contacts 196, 198 into the openings 42, 44 of the activation plugs 14, the openings 192, 194 of the plugs 158, and/or the openings 284, 286 of the integrated activation header 280. For example, the reduced height 303 and tapered ends 305 may enable the first and second activation contacts 196, 198 to include a reduced surface area at the tapered ends 305 which may enable the first and second activation contacts 196, 198 to be easily inserted into the openings 42, 44, 192, 194, 284, and/or 286 as compared to other portions of the first and second activation contacts 196, 198 that have a larger surface area.

Additionally or alternatively, the first and second activation contacts 196, 198 may include notches 306 that secure the first and second activation contacts 196, 198 to the activation plugs 14 and/or the housing 282 of the integrated activation header 280. For instance, the notches 306 may form a friction interference fit with the openings 42, 44, and/or the openings 284, 286 to block inadvertent movement of the first and second activation contacts 196, 198 with respect to the activation plugs 14 and/or the integrated activation header 280. The notches 306 may include a predetermined depth that secures the first and second activation contacts 196, 198 into the openings 42, 44, 284, and/or 286 while enabling the first and second activation contacts 196, 198 to be removed (e.g., via a tool or application of a force).

Further still, the first and second activation contacts 196, 198 may each include pronged connections 308 that facilitate coupling the first and second activation contacts 196, 198 to the load 65. For instance, the load 65 may include slots or other openings that may receive the pronged connections 308 of the first and second activation contacts 196, 198 and establish an electrical connection to the load 65. In other examples, the load 65 may have other features that enable an electrical connection between the load 65 and the pronged connections 308. In any case, the first and second activation contacts 196, 198 may be removed from the openings 192, 194 of the plugs 158 to transition the shorting block from the operating position to the shorting position.

In some examples, the shorting block 10 of the present disclosure may not include a shorting bar, which may reduce manufacturing costs of the shorting block 10. Moreover, the configuration of the first and second shorting contacts 60, 62 enables the shorting block 10 to include a reduced length and/or width, which reduces a size of the shorting block 10. Utilizing first and second shorting contacts 60, 62 that are mirror-images of one another may also simplify manufacturing of the shorting block, which further reduces costs. Finally, the shorting block 10 of the present disclosure ensures that the current transformer 63 is maintained within a closed loop circuit in the shorting position, in the operating position, and during a transition between the shorting position and the operating position.

The embodiments set forth in the present disclosure may be susceptible to various modifications and alternative forms, specific embodiments have been shown by way of example in the drawings and have been described in detail herein. However, it may be understood that the disclosure is not intended to be limited to the particular forms disclosed. The disclosure is to cover all modifications, equivalents, and alternatives falling within the spirit and scope of the disclosure as defined by the following appended claims. In addition, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). For any claims containing elements designated in any other manner, however, it is intended that such elements are not to be interpreted under 35 U.S.C. 112(f).

The invention claimed is:

1. A shorting block, comprising:

a first shorting contact electrically configured to couple to a first terminal of a current transformer, wherein the first shorting contact comprises a first contact portion;

a second shorting contact electrically configured to couple to a second terminal of the current transformer, wherein the second shorting contact comprises a second contact portion, and wherein the first contact portion and the second contact portion are configured to electrically contact the first shorting contact and the second shorting contact in a shorting position of the shorting block to cause the current transformer to short circuit when in the shorting position;

a first activation contact configured to electrically couple to an electrical load; and a second activation contact configured to electrically couple to the electrical load, wherein the first activation contact and the second activation contact are configured to be inserted into the first shorting contact and the second shorting contact, respectively, such that the first activation contact and the second activation contact direct the first contact portion and the second contact portion away from one another to form a gap between the first contact portion and the second contact portion in an operating position of the shorting block.

2. The shorting block of claim 1, wherein the first activation contact and the second activation contact comprise a conductive material.

3. The shorting block of claim 1, wherein the first shorting contact comprises a third contact portion and the second shorting contact comprises a fourth contact portion, wherein the first contact portion and the third contact portion are configured to form a first opening in the shorting position to facilitate insertion of the first activation contact, and wherein the second contact portion and the fourth contact portion are configured to form a second opening in the shorting position to facilitate insertion of the second activation contact.

4. The shorting block of claim 1, wherein the first contact portion and the second contact portion are configured to maintain contact with one another when the first activation contact is inserted into the first shorting contact and the second activation contact is not inserted into the second shorting contact.

5. The shorting block of claim 1, comprising a housing, wherein the first shorting contact and the second shorting contact are disposed within the housing, and wherein at least a portion of the first activation contact and at least a portion of the second activation contact extend into the housing in the operating position of the shorting block.

6. The shorting block of claim 1, wherein the first shorting contact and the second shorting contact are disposed within a plug, wherein the plug comprises a wall configured to exert a first force on the first shorting contact, and wherein the first force is in an opposite direction of a second force applied to the first contact portion of the first shorting contact by the second shorting contact.

7. The shorting block of claim 1, wherein the first and second shorting contacts electrically couple in the shorting position without a separate shorting element.

8. The shorting block of claim 1, comprising an activation plug configured to receive the first activation contact and the second activation contact, wherein the first activation contact, the second activation contact, or both, comprise a notch configured to secure the first activation contact, the second activation contact, or both, to the activation plug.

9. The shorting block of claim 8, wherein the activation plug comprises a securement feature to further secure the first activation contact, the second activation contact, or both, to the activation plug via a friction interference fit.

10. The shorting block of claim 1, wherein the first shorting contact, the second shorting contact or both, comprise a shorting portion having an overlapping member coupled to a biased portion, and wherein the overlapping member and the biased portion overlap with one another along a width of the first shorting contact, the second shorting contact, or both.

11. An electric power system, comprising:

a current transformer comprising a primary winding and a secondary winding;

an electrical load configured to electrically couple to the secondary winding of the current transformer; and a shorting block configured to couple the current transformer to the electrical load, wherein the shorting block comprises:

a first shorting contact electrically coupled to a first terminal of the current transformer;

a second shorting contact electrically coupled to a second terminal of the current transformer, wherein the first shorting contact and the second shorting contact are configured to contact one another in a shorting position of the shorting block;

a first activation contact electrically coupled to the electrical load; and a second activation contact electrically coupled to the electrical load, wherein the first activation contact and the second activation contact are configured to be inserted into the first shorting contact and the second shorting contact, respectively, to form a gap between the first shorting contact and the second shorting contact in an operating position of the shorting block.

12. The electric power system of claim 11, wherein the first shorting contact and the second shorting contact do not directly contact one another in the operating position of the shorting block.

13. The electric power system of claim 11, wherein the first activation contact and the second activation contact comprise a conductive material.

14. The electric power system of claim 13, wherein the conductive material comprises tin, nickel, copper, or any combination thereof.

15. The electric power system of claim 11, wherein the first activation contact comprises a tapered end configured to facilitate insertion of the first activation contact into the first shorting contact.

16. A connector for a shorting block, comprising:

a body configured to couple to a current transformer;

an overlapping member coupled to the body;

a biased portion coupled to the overlapping member via a bent portion, wherein the overlapping member and the biased portion overlap with one another with respect to a width of the body;

a first contact portion coupled to the biased portion, wherein the biased portion is configured to bias the first contact portion in a direction away from the overlapping member; and a second contact portion coupled to the biased portion, wherein a gap is formed between the first contact portion and the second contact portion in a shorting position of the shorting block, and wherein the first contact portion and the second contact portion are electrically coupled to one another in an operating position of the shorting block;

wherein the bent portion comprises a bend-back shape that allows electrical coupling and the gap to be formed to by insertion of a male contact.

17. The connector of claim 16, wherein the body comprises an opening configured to couple the connector to the current transformer.

18. The connector of claim 16, comprising a lip configured to secure the connector to a housing of the shorting block.

19. The connector of claim 16, wherein the first contact portion and the second contact portion are configured to directly contact one another in a default position.

* * * * *